US011311767B1

(12) United States Patent
Boyd

(10) Patent No.: US 11,311,767 B1
(45) Date of Patent: Apr. 26, 2022

(54) GEODESIC DOME EXERCISING SYSTEM

(71) Applicant: Bruce Boyd, Dallas, TX (US)

(72) Inventor: Bruce Boyd, Dallas, TX (US)

( * ) Notice: Subject to any disclaimer, the term of this patent is extended or adjusted under 35 U.S.C. 154(b) by 0 days.

(21) Appl. No.: 17/018,936

(22) Filed: Sep. 11, 2020

(51) Int. Cl.

| | |
|---|---|
| ***A63B 21/04*** | (2006.01) |
| ***A63B 21/055*** | (2006.01) |
| ***A63B 21/00*** | (2006.01) |
| ***A63B 21/22*** | (2006.01) |

(52) U.S. Cl.
CPC ..... *A63B 21/0435* (2013.01); *A63B 21/0442* (2013.01); *A63B 21/0557* (2013.01); *A63B 21/153* (2013.01); *A63B 21/154* (2013.01); *A63B 21/225* (2013.01); *A63B 21/4003* (2015.10); *A63B 21/4009* (2015.10); *A63B 21/4013* (2015.10); *A63B 21/4035* (2015.10); *A63B 21/4043* (2015.10)

(58) Field of Classification Search
CPC ..... A63B 21/0435; A63B 21/0442; A63B 21/0557; A63B 21/153; A63B 21/154; A63B 21/225; A63B 21/4003; A63B 21/4009; A63B 21/4013; A63B 21/4035; A63B 21/4043
See application file for complete search history.

(56) References Cited

U.S. PATENT DOCUMENTS

| | | | | |
|---|---|---|---|---|
| 4,084,812 | A | 4/1978 | Melrose et al. | |
| 4,097,043 | A | 6/1978 | Rudy | |
| 9,259,606 | B2 | 2/2016 | Wolan | |
| 2012/0180405 | A1* | 7/2012 | Drake | E04B 1/3211 52/81.3 |
| 2018/0028854 | A1* | 2/2018 | Carter | A63B 21/16 |
| 2018/0339184 | A1* | 11/2018 | Dreytser | A63B 21/16 |
| 2019/0390454 | A1* | 12/2019 | Kalenak | E04B 7/102 |
| 2020/0254298 | A1 | 8/2020 | Innocenzi | |

FOREIGN PATENT DOCUMENTS

| | | | |
|---|---|---|---|
| WO | 2020014667 | A1 | 1/2020 |

OTHER PUBLICATIONS https://www.hearthsong.eom/p/731940; SunRise Climbing Dome; Oct. 2, 2017 (Year: 2017).*
https://www.walmart.com/ip/Lifetime-Dome-Climber-Earthtone; Lifetime Dome Climber; Jun. 29, 2019 (Year: 2019).*
International Search Authority (ISA), "International Search Report," International Application No. PCT/US2021/49558, dated Dec. 29, 2021, 3 pages, publisher Commissioner for Patents—PCT, Alexandria, Virginia, United States of America.
International Search Authority (ISA), "Written Opinion of the International Searching Authority," International Application No. PCT/US2021/49558, dated Dec. 29, 2021, 18 pages, publisher Commissioner for Patents—PCT, Alexandria, Virginia, United States of America.

(Continued)

*Primary Examiner* — Andrew S Lo
*Assistant Examiner* — Andrew M Kobylarz
(74) *Attorney, Agent, or Firm* — Fogarty LLP

(57) ABSTRACT

The present invention relates an exercising system. The exercising system is a geodesic dome structure coupled with an exercise device such as a flywheel. The geodesic dome is made up of multiple struts coupled to each other at multiple hubs. The exercise device is engaged with the hub to allow a user to exercise through the flywheel.

19 Claims, 9 Drawing Sheets

(56) References Cited

OTHER PUBLICATIONS

"Lifetime 66" Climbing Dome / Model 90951 / Lifetime Assembly Video (Lifetime Products) Feb. 13, 2020, retrieved from [online] URL:https://www.youtube.com/watch?v=7quuSs3L8-k>, retrieved from entire document.
"How to I Rack Mount Setup" (Exerfly) May 23, 2020 [online] retrieved from <URL:https://www.youtube.com/watch?v=Uq0hJAvyZvk>, entire document.
"Titan Fitness Pulley system" (Mike Likes) Jun. 26, 2019, [online] retrieved from <URL:https://www.youtube.com/watch?v=XWMechdQlsU>, entire document.
"Stroops Connectus: Group Training Anchor" (Stroops) Apr. 19, 2019 [online] retrieved from <URL:https://www.youtube.com/watch?v=u6CK0knJKjU>, entire document.

* cited by examiner

GEODESIC DOME EXERCISING SYSTEM

FIELD OF INVENTION

The invention relates to an exercising system. More particularly, the invention relates to a geodesic dome based exercising system that can be engaged with a variety of exercise devices.

BACKGROUND

For physical exercise, people often go to gyms to use heavy exercise machines that are each suited for a specific exercise. Some people also work out at home using a home gym, portable exercise equipment, or individual exercise devices, such as treadmills or elliptical machines. Alternatively, people go to the parks or public places where there may be basic exercising systems or jogging trails. It is apparent that numerous methods and systems in the prior that are adequate for various exercise and workout purposes. However, the existing exercise devices do not provide a single system that can be adapted for a wide variety of exercises performed with different weights and resistances in different configurations.

SUMMARY

The present invention generally relates to an exercise system which includes a geodesic dome that forms a platform for engaging with exercise devices. The geodesic dome provided in the invention is similar to the playground equipment popularly used by the children to hang, climb, or sit. A geodesic dome is a hemispherical structure based on a geodesic polyhedron and is described in connection with an example embodiment herein; however, it will be understood that any dome structure, geodesic or otherwise, may be used as a component of the invention.

The geodesic dome is formed by a number of struts that are joined end to end to form hubs or joints. An exercise device, such as a resistance band or a flywheel-resistance pulley system, is attached to a hub of the geodesic dome. The connection of multiple struts with one another can be achieved in different ways. Primarily, the hubs can be formed by connecting all the struts directly together by overlapping the corners of the struts with a nut. Alternatively, the hub is a separate plate (e.g. a strut plate) used to link or attach the struts. These hubs or joints have engaging members or attachment members with which different exercising devices can be attached. The exercising device can either be a flywheel or a resistance band etc. Moreover, the geodesic dome provides a great degree of movement and ease of use for the users.

The primary objective of the present invention is to provide an overall exercise system that allows multiple exercise devices to be attached at different points on the dome structure. The exercise system includes a dome-shaped structure or any structure that includes multiple attachment points. A variety of exercise apparatus, such as a flywheel-resistance exercise apparatus, resistance band, or a weight-stack pulley system can be used at the same time in conjunction with the geodesic dome to provide an outdoor exercise system.

The exercise system of the present invention provides one or more engaging members that are coupled with the hubs. These engaging members may be mechanically coupled or welded onto the hubs. The engaging member are in the form of rings, hooks etc., to provide a connection between the dome structure and an exercise device.

A flywheel-resistance system is one example of an exercise devices that can be attached to the dome of the exercise system. In one embodiment, a person wears a belt around their abdomen and the belt is connected to the flywheel-resistance system. The rotational speed of the flywheel is proportional to the resistance experienced by the person while moving or stretching. Faster the stretching movement of the person, faster is the rotation of the flywheel and vice-versa.

A user can attach a resistance band or a cable pulley to an engaging member for the purpose of exercising or stretching. For example, a resistance band can be attached to the hub so that the user can pull the resistance band with his or her hands. Similarly, a pulley may be attached to any of the hubs on the exercise device so that the angle of motion, the amount of weight, and the range of motion may be varied. An individual pulley could be attached to any of the hub depending upon the exercise the user wants to perform. The overall exercise system allows multiple users to simultaneously use the exercise system and perform different exercises by coupling different exercising devices. Additionally, the exercise system allows sufficient distance maintained by the users.

The other objective of the present invention is that the exercise system can be mounted at different levels and angles relative to a user on the geodesic dome which facilitates almost any exercise or range of motion.

Another objective of the present invention is to provide a number of engaging members on the hubs that allows multiple users to exercise at the same time. Also, the engaging members can be fixedly oriented inward or outward, or may be rotated from an inside to an outside position depending on whether the user is inside or outside the geodesic dome.

Yet another objective of the present invention is to provide a spacious exercise system for exercising inside the geodesic dome. For entering the geodesic dome, a small opening is present in the geodesic dome. The opening allows users to enter the dome by walking, stooping, or crawling in.

Yet another objective of the present invention is to provide full body workout. The invention also allows for the use of any other attachment member such as attachment to a user's arm, hand, leg, foot, head, neck, or chest. Also, the struts of the geodesic dome can be used for pullups, chinups, or other body-weight exercises. Thus, the invention enables multiple users to enjoy a gym-like experience using the dome structure.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Although, the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

The presence of broadening words and phrases such as "one or more," "at least," "but not limited to" or other like phrases in some instances shall not be read to mean that the narrower case is intended or required in instances where such broadening phrases may be absent.

BRIEF DESCRIPTION OF DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION

Figure 1:
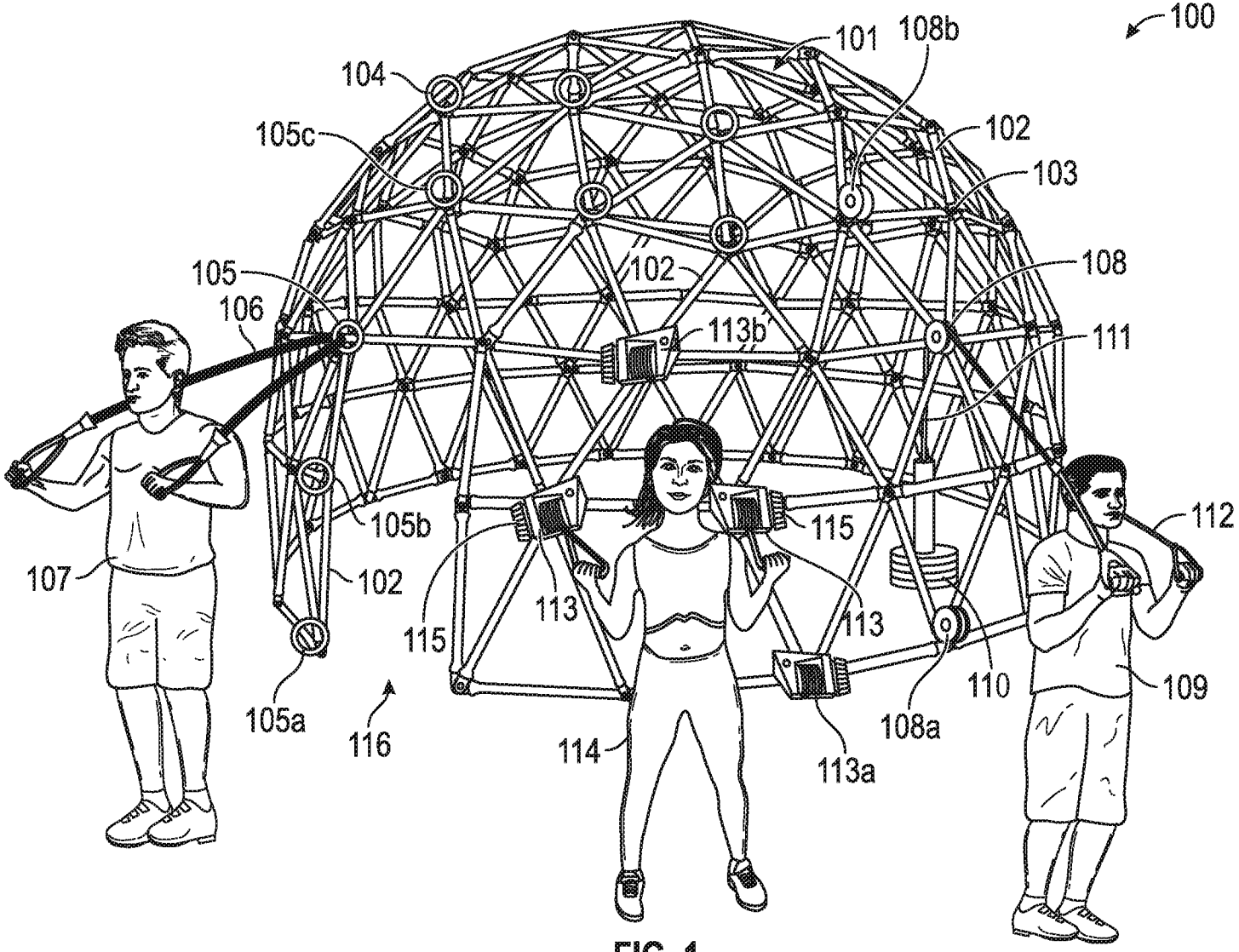
FIG. 1 illustrates an exercising system of the present invention.

FIG. 1 illustrates an exercising system 100 of the present invention, which may be referred to as a Matrix Performance System (MPS) in some embodiments. The exercising system includes a geodesic dome 101 having a plurality of struts 102 that are joined end to end by hubs or joints 103. The connection of one or more of struts 102 can be achieved in different ways. The hubs 103 can be formed by connecting all the struts directly together, such as by bolting or welding a group of struts 102 together. Alternatively, a separate plate or a hub device (not shown) may be attached to a group of struts 102 to link the together. An engaging member or attachment member 104 is coupled to one or more of the hubs 103. The engaging members 104 are configured to allow various exercise equipment to attach to geodesic dome 101. In a simple form, the engaging members 104 may be a ring or loop as shown in FIG. 1. However, it will be understood that in other embodiments, the engaging member may be any appropriate device for securely connecting exercise equipment to hubs 103, such as, for example, a socket, shackle, buckle, bolt, screw, pin, cotter pin, hook, clamp, or linkage.

The exercise equipment may be any device or apparatus that generates a force or resistance that a person may use for exercise, such as weight training, stretching, isotonic exercises, plyometric exercises, or isometric exercises. For example, engaging member 105 may be configured to attach resistance band 106 exercise equipment to geodesic dome 101. The hubs 103 may be formed by connecting all the struts directly together through a nut. Moreover, the engaging member 105 in one embodiment is a ring passing through the nut. Alternatively, the hubs 103 can be formed by connecting all the struts 102 to a strut plate. In later case the engaging member may be a ring 105 fixed at the strut plate. The ring 105 allows a user 107 to use resistance band 106 while exercising either inside or outside geodesic dome 101. The position of ring 105 may be changed to allow user 107 to perform exercises with different muscle groups. For example, resistance band 106 may also be attached to ring 105*a*, 105*b*, or 105*c* to provide resistance at different angles, which would allow user 107 to work against a resistance at any desired angle. Moreover, multiple rings 105 or other engaging members may be attached to dome 101 to allow multiple users to exercise at the same time and/or to allow one user to exercise with multiple pieces of equipment, such as multiple exercise bands 106 (e.g., one for each arm and/or leg). The resistance band 106 may be, for example, a circular band made of a flexible material such as elastic. The resistance bands may be, for example, latex rubber stretch bands, springs, fabric, or any other appropriate material that can be used to create stretchable bands used for both physical therapy and general fitness. The length of the resistance band 106 may vary for the convenience of the user and the desired exercise motion. The different size and resistance levels of the resistance band 106 provides a wide variety of exercise variations that can target all muscle groups in the body.

It will be understood that references to exercise devices that provide resistance may also apply to equipment, devices, and apparatuses that provide assistance or provide an opposing force. For example, the exercise equipment may be a strap, such as a TRX Suspension Trainer available from Fitness Anywhere LLC, that allows a user to suspend, hang, or pull against the strap, which is anchored to a hub on the dome structure. Similarly, a cable from a resistance pulley device may be locked out so that the user may pull against the cable without the cable retracting or extending from a locked out position. An opposing force (e.g., force resisting compression) may be provided, for example, by a spring or other apparatus that pushes against the user.

In another embodiment, the engaging member may be a pulley system 108 that allows a user 109 to exercise with a stack of one or more weights 110. A cable 111 is coupled to weights 110 and runs over pulley system 108 to handle 112, which user 109 grasps to move weights 110. Handle 112 may be any appropriate device, such as a bar, strap, or other apparatus that provides a secure grip for the user. The pulley system 108 may be positioned at any hub 103 and may allow a user 109 to exercise either inside or outside dome 101. Moreover, any number of pulley systems 108 may be attached to dome 101 at one time, which would allow user 109 to exercise using multiple separate weights and/or to allow multiple users to simultaneously exercise with separate weights. The pulley system may also be positioned low or high (i.e., 108*a*, 108*b*) on dome 101 to provide a variety of positions so that user 109 may exercise different muscle groups. In some embodiments, cable 111 may run through two or more pulley systems 108 in order to provide a desired range and/or direction of movement during exercise. For example, cable 111 may run over pulley system 108 and under pulley system 108*a* to allow user 109 to exercise against a force that pulls downward.

In a further embodiment, one or more freewheel-driven resistance pulley systems 113 may be attached to a hub 103 on dome 101. Resistance pulley system 113 may comprise, for example, a cable attached to a flywheel or gear system that provides a resistance force when user 114 pulls on the cable. The amount of resistance force may vary based upon how fast user 114 pulls on the cable. Additionally, or alternatively, the resistive force may be selectable using a knob 115 on resistance pulley system 113. In an example system, the resistance pulley system 113 may use concentric biased resistance such as the POWERCLUTCH™ technology available in the MAXPRO™ exercise device available from MaxPro Fitness, LLC. Another example system is the VERSAPULLEY® inertial flywheel-training device available from Heart Rate Inc. These type of exercise machines use rotary inertia as a resistance mechanism to produce responsive or compliant resistance that automatically matches the force applied by a user. In other embodiments, a spring may be used to generate a tension or force to be used in exercise. The resistance pulley system 113 may be positioned at any hub 103 and may allow a user 114 to exercise either inside or outside dome 101. Moreover, any number of resistance pulley systems 113 may be attached to dome 101 at one time, which would allow user 114 to exercise using multiple resistance pulley systems 113 and/or to allow multiple users to simultaneously exercise with separate resistance pulley systems 113. The pulley system may also be positioned low or high (i.e., 113*a*, 113*b*) on dome 101 to provide a variety of positions so that user 114 may exercise different muscle groups and/or over different ranges and/or directions of movement during exercise.

Although FIG. 1 shows users 107, 109, and 114 exercising outside dome 101, that is merely to simplify the illustration. It will be understood that users may exercise inside or outside of dome 101. An opening 116 may be provided in dome 101 to allow users to easily move into and out of dome 101. One or more users may exercise using the same dome structure 101 at one time. Moreover, each user may exercise with one or more types of equipment at the same time. Dome structure 101 in combination with exercise equipment, such as devices 106, 110, and 113, provides a great degree of movement and ease to use for the users.

In an example embodiment, the dome 101 is made of a grid of triangles of various sizes that combine to form a hemispherical shape. It will be understood that the dome 101 is not limited to geodesic or hemispherical shape and that, in other embodiments, the dome may have a catenary, corbel, oval, umbrella, pointed, pyramidal, cloister vault, segmented, or saucer shape. The triangular elements of the dome shown in FIG. 1 are structurally rigid and distribute stresses throughout the structure, making geodesic domes able to withstand very heavy loads for their size. The construction of the dome structure is characteristically defined by a sequence of struts that are linked at a common point to create the dome's framework and shape. The dome 101 may have a steel framework; however, any other robust material, such as aluminum, carbon fiber, polyvinyl chloride (PVC), hard plastic, or wood, may be used in alternative embodiments.

The exercise system 100 may be placed in an open environment, such as in a children's playground or other outdoor space. Alternatively, the exercise system 100 may be placed in a closed structure, such as in a gym, school, or any other building.

In one embodiment, the distance from the ground to the top of dome 101 is roughly 3-3.5 meters and the internal diameter of dome 101 is roughly 6 meters. As shown in FIG. 1, groups of five or six struts 102 converge at a point to form a joint or hub 103. The network of struts 102 spreads across the entire structure of the dome 101. Each strut 102 may be approximately one meter in length and, in an example embodiment, is made from round metal pipes ranging in diameter from 15 mm to 50 mm. In other embodiments, any larger or smaller dome, with corresponding strut lengths, may be used.

The connection of struts 102 at the hubs 103 can be achieved in a number of ways. The opposing ends of each strut 102 may comprise a hole and the end of one strut 102 is joined and fastened to the ends of four or five other struts 102 with the help of a fastening member to define a hub 103. The fastening member may be, for example, a bolt, rivet, screw, or plate. To facilitate passing a fastening member such as a bolt through the holes in multiple struts 102, the ends of each strut 102 may flattened. Each hub 103 formed by the connection of five or six struts 102 has an engaging member coupled to it. The engaging member may be any appropriate device for securely connecting exercise equipment to hubs 103, such as, for example, a socket, shackle, buckle, bolt, screw, pin, cotter pin, hook, clamp, or linkage. The engaging member may be mechanically coupled to the hub 103, which would allow for movement of devices between hubs 103, or the engaging member may be permanently attached to the hub, such as by a weld or by being formed in a hub plate. The engaging member may be part of an exercise device, such as resistance pulley devices 113, or may be separate from the exercise apparatus, such as ring 105 or pulley 108.

The exercise apparatus 113 shown in FIG. 1 is a flywheel-resistance apparatus. The flywheel is given an initial spin by the user to begin exercising. As and when the user starts to pull the belt away from the flywheel apparatus 113, a resistance is felt by the user. The resistance is directly proportional to the inertia gained by the flywheel. The harder a person pulls the belt away from the device, the faster the flywheel rotates. Similarly, as the user slows down the pulling movement, lesser resistance is experienced and thus the rotation of the flywheel occurs at a slower speed. The belt of a flywheel resistance apparatus 113 as described above may be attached to cables with handles that can be gripped by the user. Alternatively, a harness or belt worn around the abdomen of a person may be attached to the belt of the flywheel resistance apparatus 113. The user may then stretch their body away from the dome to perform stretching exercise with resistance provided by the flywheel resistance apparatus 113. In addition to stretching, a user may do squats or other exercises using flywheel-resistance device 113.

A resistance band 106 or spring band may also be used to exercise on dome 101. The resistance band 106 as shown in FIG. 1 has two grip handles at its distal ends. The two grip handles at the distal ends of the band 106 are made of a material strong enough to withstand the force applied while pulling the resistance band 106 by a user. A resistance band 106 fastened to an engaging member 105 can be stretched by a user in any direction. The advantage of using a resistance band in such a manner allows a person to exercise in different position. In other embodiments, a user can crouch low and perform a stretching exercise, or a user can simply lie down on the ground and pull the band 106 with their hands toward their chest thereby modifying the conventional way of using a resistance band 106 with the help of a geodesic dome 101 not only opens up the possibility of performing stretching in different positions but also gives the users a wide variety of exercise variations to the people.

FIG. 1 illustrates multiple users exercising by attaching their exercise apparatus 106, 110/111/112, and 113 with different engaging members placed atop different hubs 103.

Also, users can attach exercise equipment to engaging members on hubs 103 located at different levels as per the convenience of the user. Since the exercise device may be mounted at many levels, almost any exercise or range of motion can be facilitated.

In an alternative embodiment, the user can attach the exercise on the inside of the dome 101. This allows multiple users to exercise at the same time, such as at least one user inside and one outside. For entering the dome, a small opening 116 is cut out of the geodesic dome 101. The opening can be of any size that lets the user enter the dome by walking, stooping, or crawling in. The height of the opening may be 1-2 meters, which may vary in alternative embodiments. The user can enter the dome and stand within the inner space of the dome. The engaging members or attachment points at each hub 103 may be fixedly oriented inward or outward, or they may be rotated from an inside to an outside position depending on whether the user is inside or outside the dome. Also, the attachment points may allow for different angles of attachment to facilitate different angles of pull relative to the dome wall.

Figure 2:
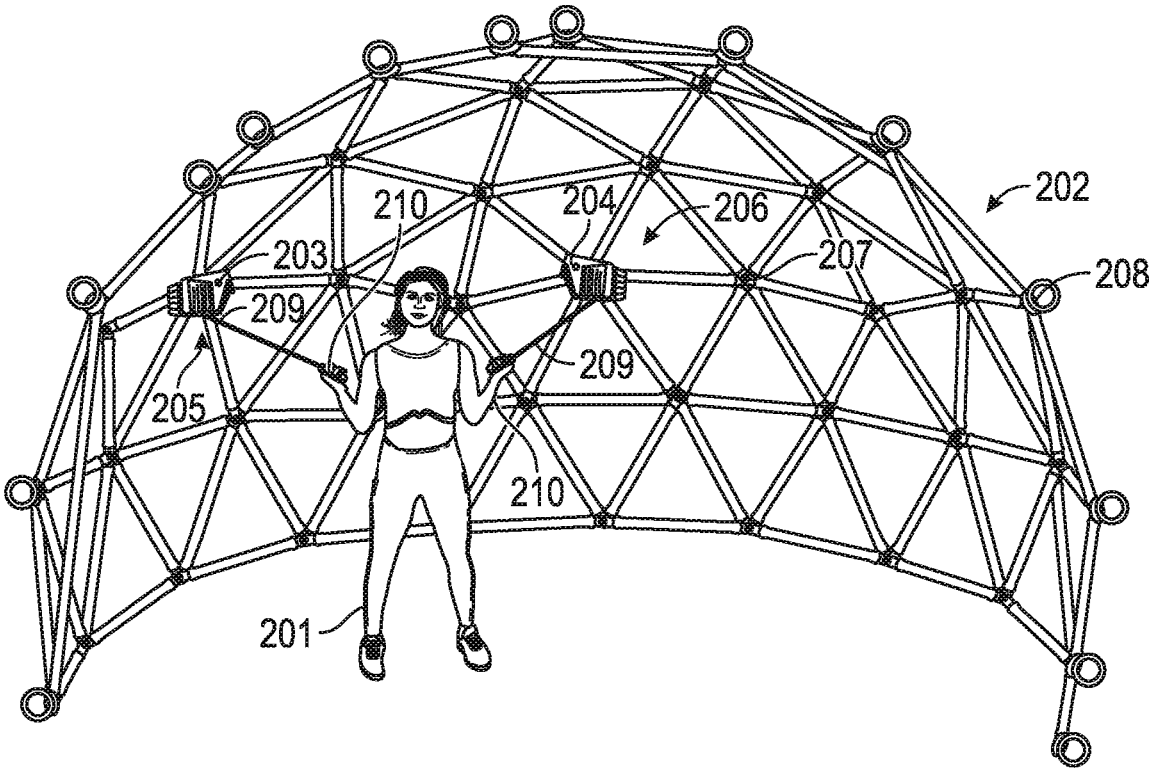
FIGS. 2-4 illustrate a cutaway view of an exercise dome structure depicting various uses of the dome exercising system with a resistance flywheel device.
Figure 3:
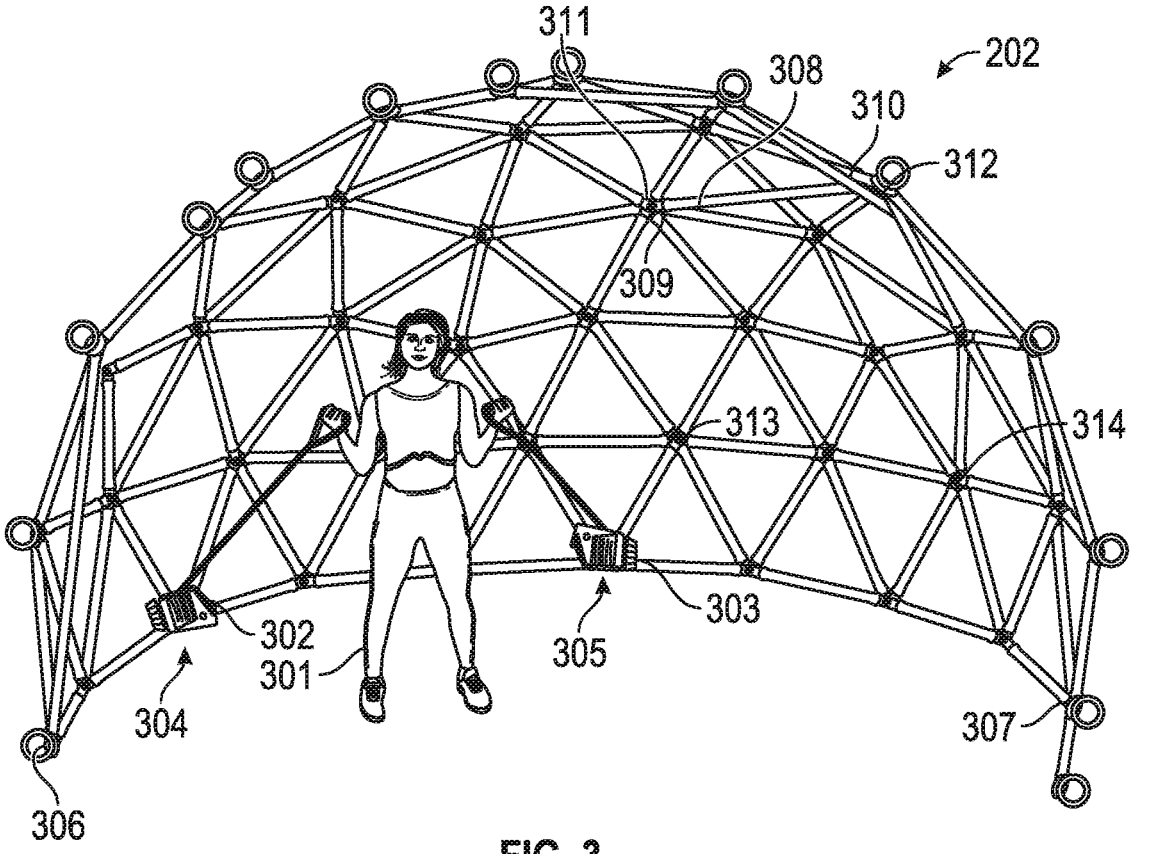
Figure 4:
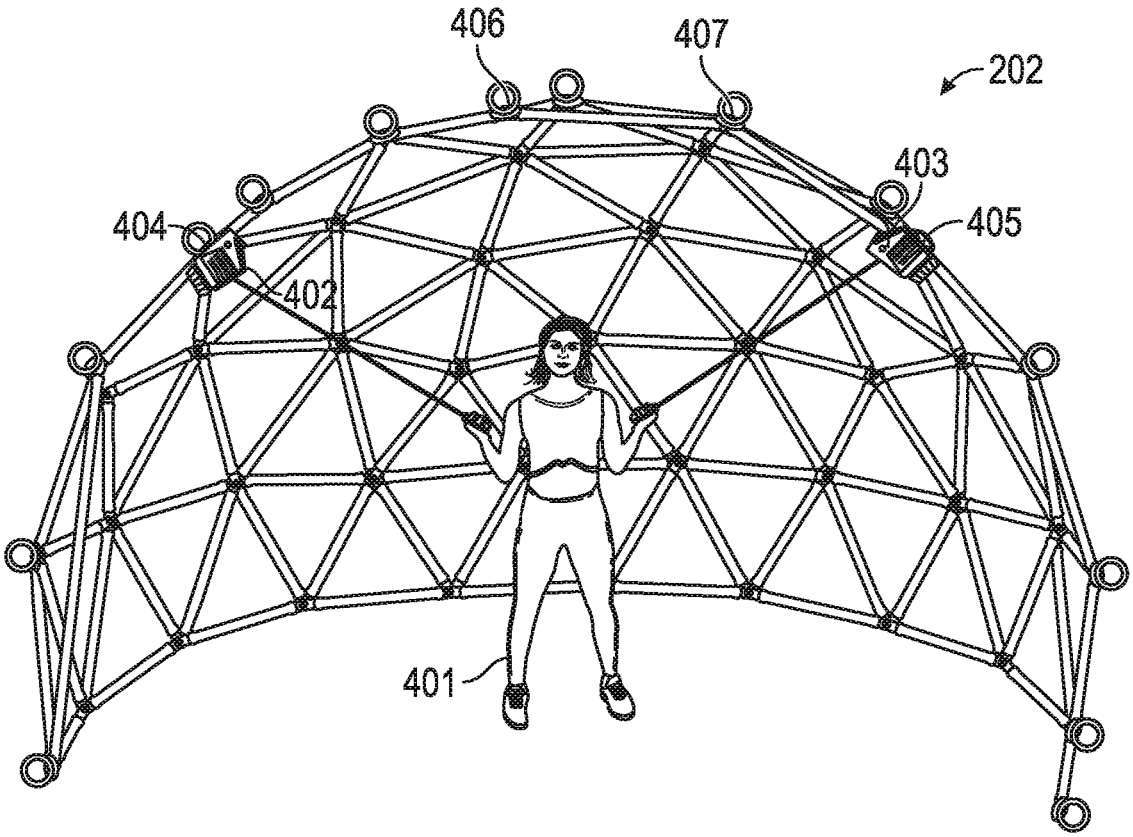

FIG. 2 is a cutaway view illustrating a user 201 exercising inside a dome structure 202. Although only a portion of dome structure 202 is shown, it will be understood to be, for example, a hemispherical or geodesic dome structure such as illustrated in FIG. 1. As shown in FIG. 2, the user 201 is exercising with two resistance pulley devices 203, 204 that have been attached to hubs 205, 206. The illustrated embodiment shows user 201 exercising with resistance pulley devices 203, 204 that are mounted at approximately shoulder height. In other embodiments, the resistance pulley devices 203, 204 may be moved to higher or lower positions as illustrated in FIGS. 3 and 4. Additionally, the resistance pulley devices 203, 204 may be attached to other hubs on dome 202. For example, resistance pulley device 204 may be moved to hub 207 or 208 in order to change the orientation between user 201 and the resistance pulley device 204, which allows of a variety of different exercises to be accomplished using the same equipment. Each resistance pulley device 203, 204 has a cable 209 that is attached to the flywheel resistance gear mechanism. Each cable 209 is attached to a handle 210 that can be gripped by user 201 to accomplish the desired exercise. Using the resistance pulley devices 203, 204 as positioned in FIG. 2, the user is able to accomplish a variety of lateral movement exercises. Cable 209 may be, for example, a wire, wire rope, coated wire, strap, cloth or plastic rope, string, or chain. Handle 210 may be held in the user's hand or may be attached to a portion of the user's body, head, or limb, such as by a strap, brace, belt, or fitting.

In other embodiments, some or all of the resistance pulley devices may be fixedly attached at a plurality of hubs on the dome structure. For example, a number of resistance pulley devices may be pre-positioned at various hub locations so that the user can quickly move from one exercise to another. The resistance pulley devices may be permanently attached to the hubs and/or some or all of the resistance pulley devices may be moved to other hub locations. Similarly, other exercise devices, such as straps, may be pre-positioned or fixedly attached at various hubs on the dome structure.

FIG. 3 is a cutaway view of dome structure 202 illustrating a user 301 exercising inside dome 202 with resistance pulley devices 302, 303, which are positioned along lower hubs 304, 305. Additionally, the resistance pulley devices 302, 303 may be attached to other hubs on dome 202. For example, resistance pulley device 302 may be moved to hub 306, and resistance pulley device 303 may be moved to hub 307, which would change the orientation between user 301 and the resistance pulley devices. In this example, the user 301 may select between a force oriented directly in front or behind them to forces oriented on either side at virtually any angle. This allows for a variety of different exercises to be accomplished using the same equipment. Using the resistance pulley devices 302, 303 as positioned low on dome 202 in FIG. 3, the user is able to accomplish a variety of exercises with movement oriented in an upward direction against the resistance.

FIG. 3 also illustrates how other exercise equipment, such as a pull up bar 308 may be attached to dome structure 202. The ends 309, 310 of bar 308 may be securely attached to engaging members, such as hooks, slots, or rings, on hubs 311, 312. Bar 308 may be extendable, which would allow it to be attached to a variety of hubs at different heights. For example, when attached as shown in FIG. 3, user 301 may perform pullup exercises on bar 308. In another embodiment, bar 308 may be placed at approximately waist height using hubs 313 and 314 to perform ballet moves using bar 308 as part of a barre workout.

FIG. 4 is a cutaway view of dome structure 202 illustrating a user 401 exercising inside dome 202 with resistance pulley devices 402, 403, which are positioned above the user's head on upper hubs 404, 405. Additionally, the resistance pulley devices 402, 403 may be attached to other hubs on dome 202. For example, resistance pulley device 402 may be moved to hub 406, and resistance pulley device 403 may be moved to hub 407, which would change the orientation between user 401 and the resistance pulley devices. In this example, the user 401 may select between a force oriented directly in front or behind them to forces oriented on either side at virtually any angle overhead. This allows for a variety of different exercises to be accomplished using the same equipment. Using the resistance pulley devices 402, 403 as positioned high on dome 202 in FIG. 4, the user is able to accomplish a variety of exercises with movement oriented in a downward direction against the resistance.

Figure 5:
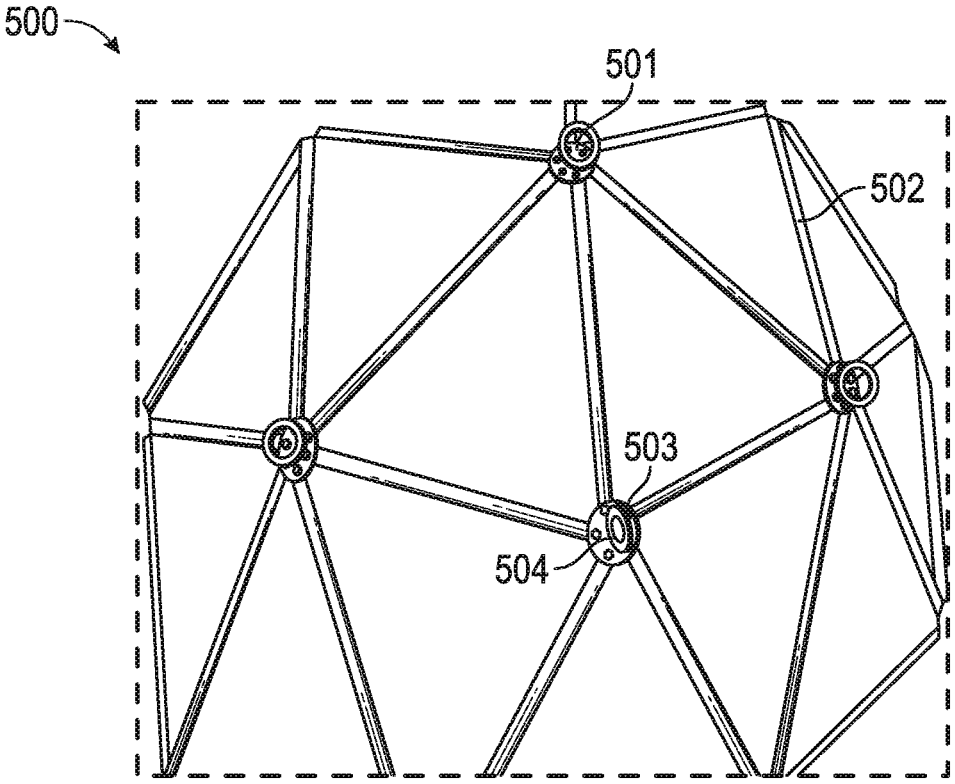
FIGS. 5 and 6 illustrate alternative methods of construction of a geodesic dome.
Figure 6:
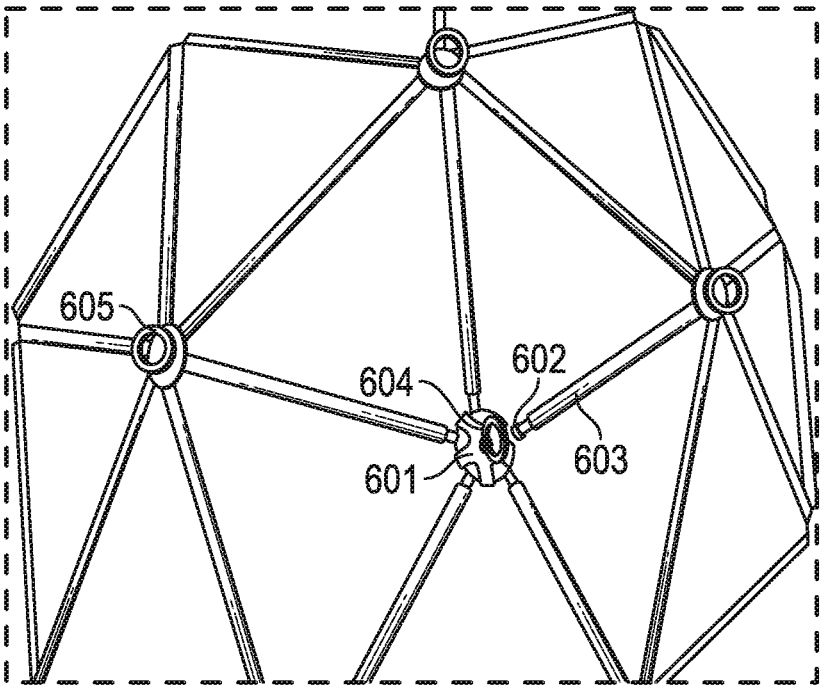

FIGS. 5 and 6 illustrate alternative methods of construction of a geodesic dome, such as the how the struts of the geodesic dome are configured. Referring to FIG. 5, a strut plate 501 is configured with a hub formed by multiple struts 502 in the exercising system 100 of the present invention. A group of struts 502 converge at a common point known as a hub in a geodesic dome 500 similar to FIG. 1. Each strut 502 is a steel rod with a cylindrical body having a flat surface towards its ends. The opposing ends of each strut 502 have a hole to allow a fastening member 503 such as a nut to pass through. In the configuration, a strut plate 501 acts as the attachment point. The strut plate 501 is nothing but a circular structure having one or more receiving members to receive the fastening members 503 passing through the holes at the ends of each strut 502. A number of fastening members 503 passing through the holes at the opposing ends of the struts 502 are screwed into the receiving members present on the surface of the strut plate 501. Moreover, an engaging member 504 is fixed at the strut plate 501 toward the center. The engaging member 504 may be a ring, hook, or buckle, for example.

Referring to FIG. 6, a strut plate 601 is attached by ball connectors 602 to a hub formed by multiple struts 603 in the exercising system 100 of the present invention. The struts 603 may be made of steel, plastic, aluminum, carbon fiber, polyvinyl chloride (PVC), or wood and have ball connectors 602 screwed to their ends. These ball connectors 602 are received by the receiving members 604 of a strut plate 601.

The connection between the ball connector 602 on struts 603 and the strut plate 601 is a ball and socket connection. The struts 603 in this case have a cylindrical body throughout their structure. The receiving members on the surface of the strut plate 601 provide enough area for the movement of strut rods laterally thus making the struts moveable. Moreover, the struts 603 can be rotated around the ball-connector (e.g. 60 degrees laterally in all directions and 360 degrees around the strut axis. An engaging member 605 is fixed at the strut plate 501 toward the center. The engaging member 605 may be a ring, hook, or buckle, for example.

Figure 7:
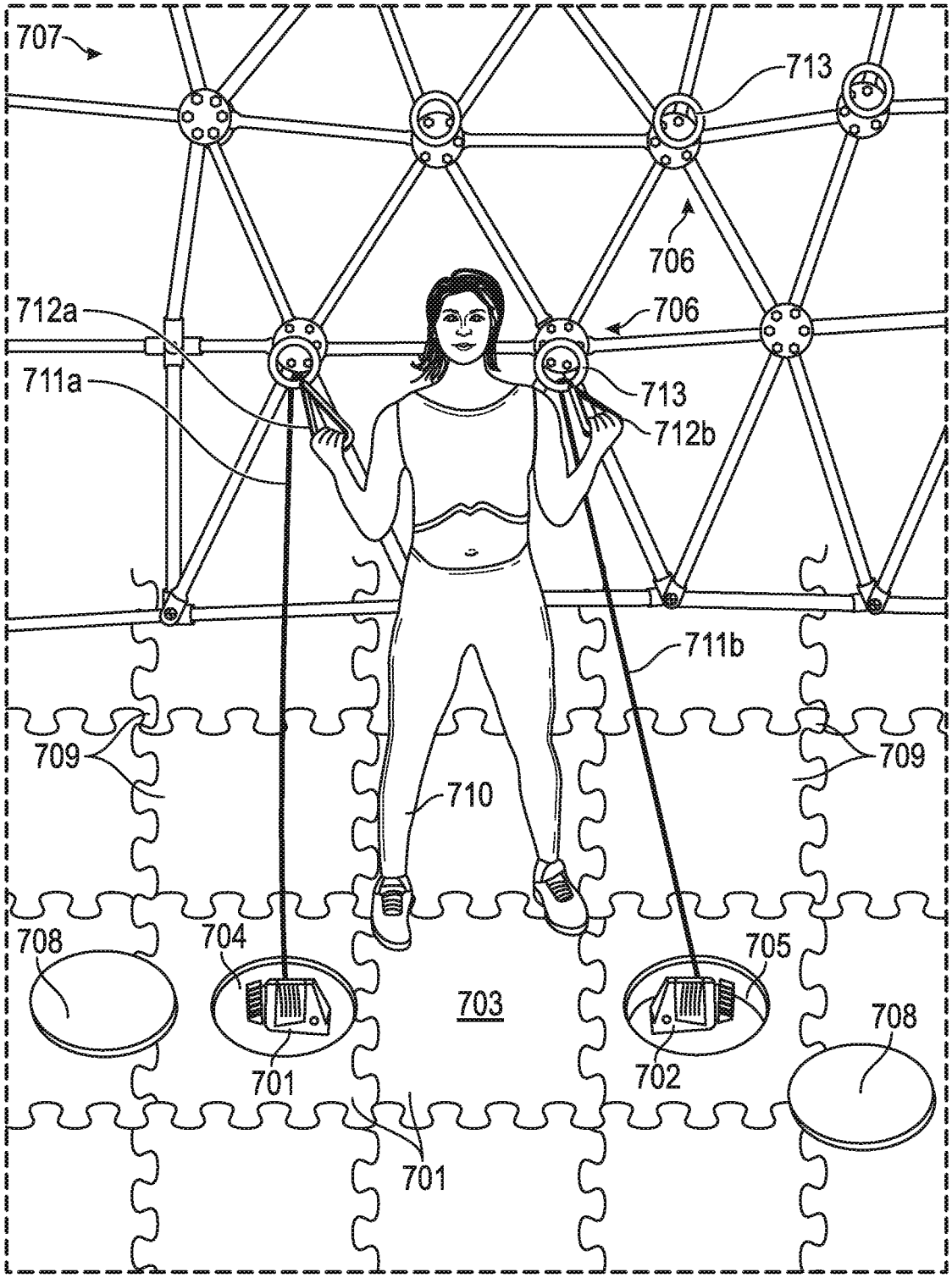
FIG. 7 illustrates an alternative location for the flywheel resistance pulley devices as configured with a geodesic dome exercising system.

FIG. 7 illustrates an alternative placement of resistance pulley devices 701, 702, which can be mounted on or under the floor 703. In one embodiment, resistance pulley devices 701, 702 are positioned in openings 704, 705 in floor 703. Openings 704, 705 may be holes created in floor 703 that are configured to receive a resistance pulley device 701 or 702, which may be mounted either permanently in opening 704, 705 or may be moveable between an engaging device in opening 704, 705 and an engaging member on a hub 706 of dome structure 707. The openings 704, 705 may always be exposed or a cover 708 may be used to cover the opening 704 and/or 705 when not in use. When cover(s) 708 are in place, floor 703 is a flat surface. In some embodiments, an exercise mat may be placed on floor 703 and under dome structure 707. The exercise mat may be a single surface or may comprise, for example, a plurality of interlocking foam or carpet tiles 709. Covers 708 may be adapted to work with the tiles 709 to provide a smooth surface on floor 703 when holes 704, 705 are closed.

FIG. 7 further illustrates a user 710 exercising with resistance pulley devices 701 and 702 in an example embodiment. Resistance pulley devices 701 and 702 each have a cable 711 that ends in a handle 712, which a user 710 can grab with her hands. In other embodiments, the handles 712 may be straps that can be attached to the user's arms, legs, torso, etc.

Cable 711*a* from resistance pulley device 701 runs directly to the right hand of user 710, but cable 711*b* from resistance pulley device 702 is routed through an engaging device 713 on dome structure 707 and then to the left hand of user 710. As a result, user 710 feels tension in her right hand in a vertical direction that is generally perpendicular to floor 703, while her left hand works against a tension that is generally horizontal and parallel to floor 703. Using engaging devices 713 on dome structure 707 in connection with resistance pulley devices 701, 702, user 710 can configure exercise movements in any desired direction. The flywheel in the resistance pulley devices 701, 702 rotates when the user starts exercising. As the user stretches their hands away from the geodesic dome 707, the user feels some resistance which is proportional to the rotational movement of the flywheel. The geodesic dome 707 may be capable of accepting additional flywheel resistance pulley devices that are attached to hubs 706.

An example use case for dome structure 707 is providing the dome structure, which comprises a plurality of struts linked together at a plurality of hubs, wherein two or more of the hubs comprise a coupling or attaching member for securely connecting to exercise equipment. A first exercise device is connected to a first coupling member on the dome structure. A second exercise device is connected to a second coupling member on the dome structure. A cable from the first exercise device is attached to a user. A cable from the second exercise device is attached to the user. For example, the cables may have handles that are held by the user, or the cable may be attached to a strap, brace, belt, or fitting on the user's body. The user may then perform exercises using the exercise equipment. Then the first exercise device may be moved to a third coupling member on the dome structure, and/or the second exercise device may be moved to a fourth coupling member. Moving the first exercise device between the first coupling member and the second coupling member on the dome structure (and/or moving the second exercise device between the second coupling member and the fourth coupling member) causes a change in the direction of resistance applied to the user. The exercise devices may be, connected to the dome structure, attached to the user, and/or moved among coupling members by the user or by a trainer or therapist, for example.

Figure 8:
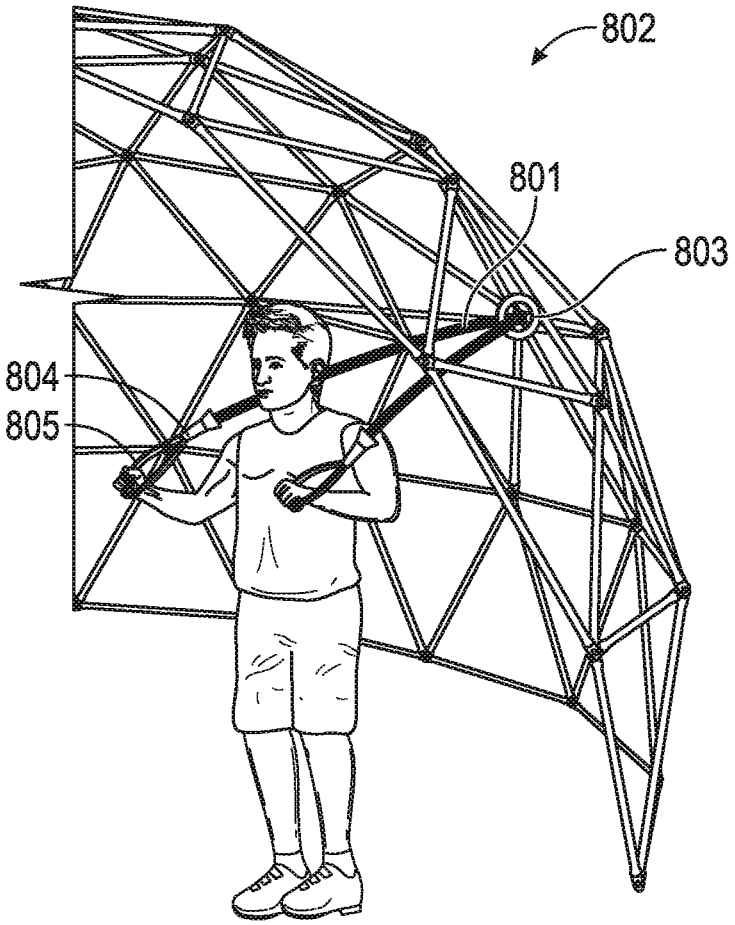
FIG. 8 illustrates a resistance band exercise device configured with the geodesic dome of the exercising system.

FIG. 8 illustrates a resistance band 801 device configured with a geodesic dome 802 of the exercising system. The resistance band 801 is connected with the engaging member 803. The band includes two distal ends 804 that are attached to handles 805. Generally, the resistance band 801 interconnects the two handles 805. The user holds the two handles 805, and the band 801 takes a U-shape. The portion of the resistance band 801 connected to the two distal ends 804 is stretched away from dome 802. A resisting force is experienced by the user as the resistance band 801 is stretched outwards. The handles 805 are generally made of a material strong enough such that they are able to withstand the force applied by the user away from the ground in the upward direction. In context with the geodesic dome 802, the resistance band 801 may be attached to different levels on the dome 802 depending on the exercise the user wishes to perform The length of the resistance band 801 typically ranges from 1.5-2 meters. The different size and resistance levels of these bands give a wide variety of exercise variations that can target all muscle groups in the body. Resistance bands 801 can come straight, with attached handles, or formed into a loop. The resistance band shown is made of an elastic material with excellent elasticity and tensile strength. The band may also include straps, matrices, cord and other similarly functioning structures and materials. In some cases, band includes an elastomeric polymer material.

Figure 9:
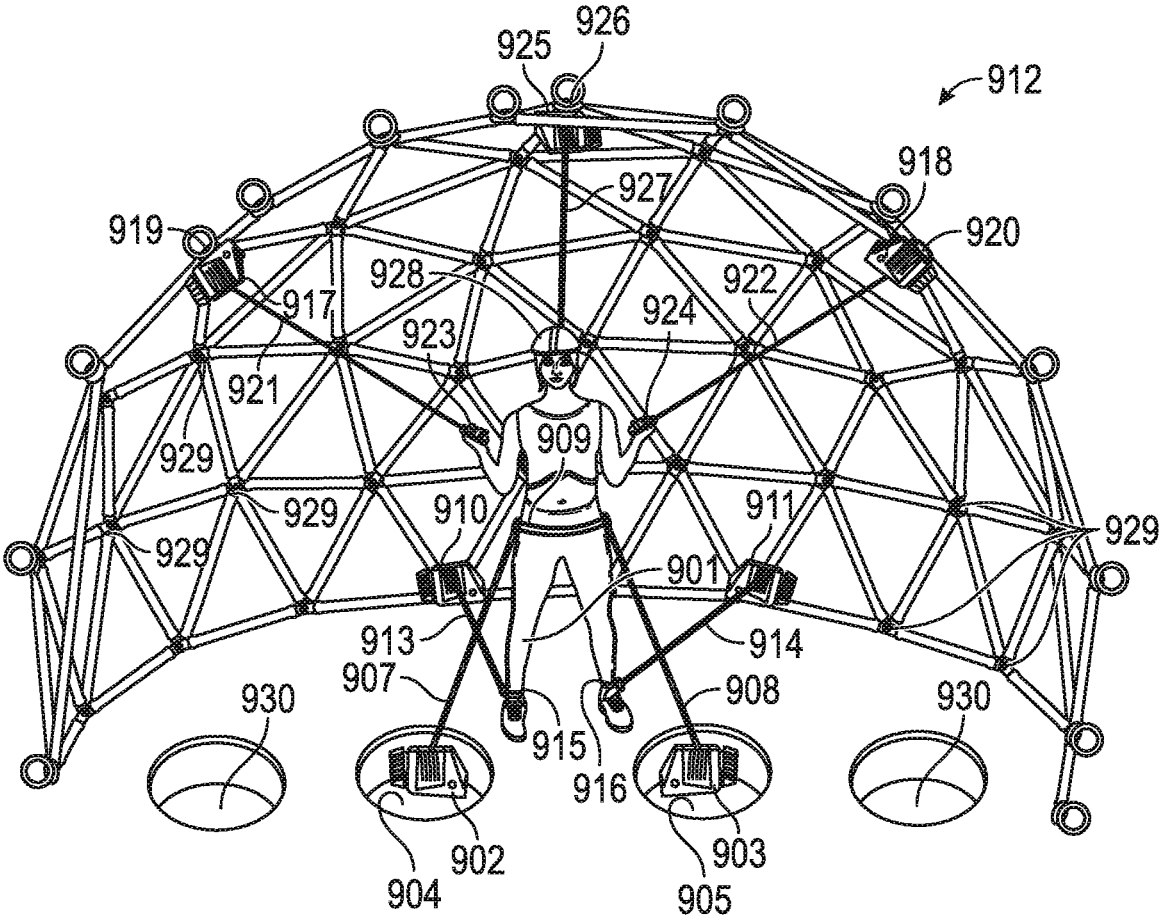
FIG. 9 illustrates a user exercising multiple extremities using various movements in connection with an exercising dome system.

FIG. 9 illustrates a user 901 exercising multiple extremities using various movements in connection with an exercising dome system. One set of resistance pulley devices 902, 903 are mounted in holes 904, 905 in the floor 906 of an exercise facility. Resistance pulley devices 902, 903 are attached by cables 907, 908 to a belt 909 worn at the waist of user 901. This configuration creates a downward resistance force, which would allow user to perform squat or jumping motions, for example, that exercise leg muscles such as quadriceps, hamstrings, calves, and glutes. User 901's lower back, obliques, abdominals, and shins may also be engaged in such exercises.

Another set of resistance pulley devices 910, 911 are mounted in on hubs positioned low on dome structure 912. It will be understood that only a portion of the dome structure 912 is shown to simplify the drawing. Resistance pulley devices 910, 911 are attached by cables 913, 914 to straps 915, 916 worn at the ankles of user 901. This configuration creates lateral and downward resistance forces, for example, which would allow user 901 to perform kicking motions that exercise leg muscles.

A further set of resistance pulley devices 917, 918 are mounted in on hubs 919, 920 that are positioned high on dome structure 912. Resistance pulley devices 917, 918 are attached by cables 921, 922 to handles 923, 924 that are held in the hands of user 901. This configuration creates a lateral and upward resistance forces, for example, which would allow user 901 to perform punching, pulling, and pressing motions that exercise arm and upper body muscles.

Another resistance pulley device 925 is mounted in on hub 926 positioned at the top of dome structure 912. Resistance pulley device 925 is attached by cable 927 to a helmet or headband device 928 worn on the head of user 901. This configuration creates a resistance force that would allow user 901 exercise neck and shoulder muscles.

It will be understood that any of the resistance pulley devices 902, 903, 910, 911, 917, 918, 925 may be positioned at other locations, such as at any other hub 929 on dome structure 912 or any other opening 930 in floor 906. Additional resistance pulley devices may also be added and attached to user 901 at other places. While not shown in the drawing, hubs in front of user 901 may also be used to attach resistance pulley devices. For example, resistance pulley devices 910 and 911 could be positioned in front of user 910 to provide forces that oppose backward kicks or leg motions. As illustrated in FIG. 9, the ability to place the resistance pulley devices in almost any position and configuration allows user 901 to create tensions and forces to assist in exercising in almost any direction, range, or motion.

Figure 10:
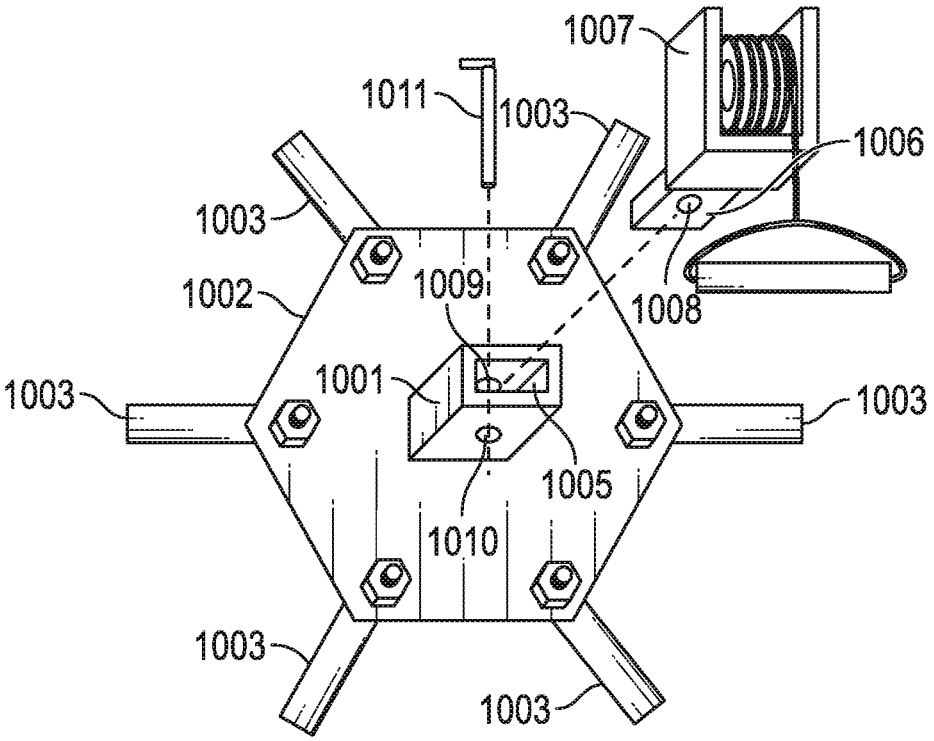
FIG. 10 illustrates an engaging device for exercise equipment according to an example embodiment.

FIG. 10 illustrates an engaging device for exercise equipment according to an example embodiment. Engaging device 1001 is attached to a hub plate 1002, which may be coupled to a plurality of struts 1003 on a dome structure, such as a geodesic dome frame. Struts 1003 may be attached to hub plate 1002 by bolts, rivets, welds, adhesive, or any other appropriate attachment method based on the materials used. Similarly, engaging device 1001 may be attached to hub plate by bolts, rivets, welds, adhesive, or any other appropriate attachment method based on the materials used. Engaging device 1001 has a hollow central opening 1005 that is configured to function as a receiver for a stub 1006 on an exercise device 1007. Stub 1006 fits snuggly within opening 1005. When stub 1006 is positioned within opening 1005, hole 1008 in stub 1006 aligns with holes 1009 and 1010 in engaging device 1001. A hitch pin 1011 is configured to fit into and through all three holes 1008, 1009, and 1010, which locks stub 1006 within engaging device 1001 so that exercise device 1007 is securely attached to hub plate 1002. Exercise device 1007 may be a resistance pulley device or any other exercise apparatus. Engaging devices 1001 may be placed on all or some hubs and/or hub plates on a dome structure, which would allow for exercise device 1007 to be moved to any position on the dome. Additionally, the engaging device 1001 may be attached on the front and/or back side of hub plate 1002 so that exercise devices 1001 may be positioned facing both inwardly or outwardly relative to the dome structure at each hub location. Although the illustrated engaging device is shown as having a rectangular cross section, it will be understood that any appropriate shape may be used, such as, for example, a circular, oval, square, hexagonal, or other shape.

Figure 11:
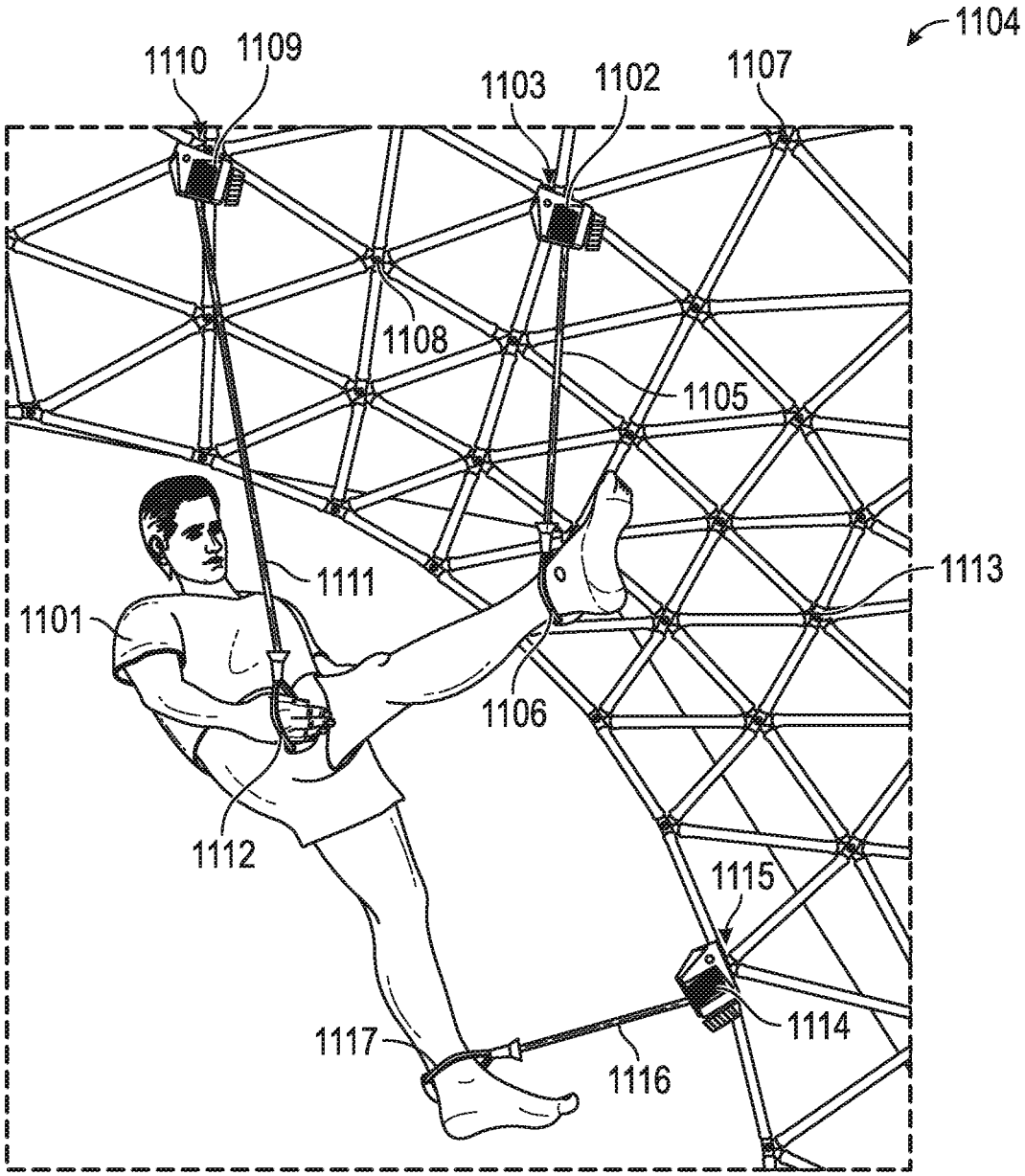
FIG. 11 illustrates a user exercising with an exercising dome system.

FIG. 11 illustrates a user 1101 exercising multiple extremities using various movements in connection with an exercising dome system. User 1101 is shown performing various exercises while on his back to illustrate the versatility of the exercise dome system. A resistance pulley device 1102 is mounted at hub 1103 of exercise dome structure 1104. Resistance pulley device 1102 has a cable 1105 that is attached to a strap 1106 on the user's right leg. Resistance pulley device 1102 may also be moved to other hubs on exercise dome structure 1104, such a higher hub 1107 or a lower hub 1108. This allows user 1101 to vary the orientation of the resistance force applied to his right leg, which allows him to change the muscle groups impacted by the exercise using the same equipment.

Another resistance pulley device 1109 is attached to hub 1110 on exercise dome structure 1104. Resistance pulley device 1109 has a cable 1111 that is attached to a strap or handle 1112 that is held in the user's right hand. Resistance pulley device 1109 may also be moved to other hubs on exercise dome structure 1104, such hub 1108 or hub 1113. This allows user 1101 to vary the orientation of the resistance force applied to his right arm, which allows him to change the muscle groups impacted by the exercise using the same equipment.

An additional resistance pulley device 1114 is attached to hub 1115 on exercise dome structure 1104. Resistance pulley device 1114 has a cable 1116 that is attached to a strap that is attached to the user's left leg. When compared to resistance pulley device 1102, it is apparent that the exercise dome structure 1104 allows user 1101 to configure resistance pulley device 1102 and resistance pulley device 1114 so that the forces applied to each leg may be at completely different angles. This allows user 1101 to configure complex exercises to fit any desired training or therapy desired. As noted above, resistance pulley device 1114 may be moved to any other hub on exercise dome structure 1104.

Similarly, the exercise devices shown in FIG. 11 may be attached to any other point on user 1101. For example, cable 1116 may be attached to strap 1106, instead of strap 1117, so that the user 1101 has to work against two different forces while exercising his right leg. This configuration would create resistance against both a kicking motion and a side-to-side swinging motion of the user's right leg.

Moreover, any number of additional resistance pulley devices or other exercise equipment (e.g., resistance bands, straps, springs, weights, pullup bars, etc.) may be used with the configuration illustrated in FIG. 11 and may be attached to any point on user 1101.

A technological innovation of the present invention is providing an exercise structure having a surrounding structure with a wide variety of targeted exercises and programs that are infinitely functional for use with physical rehabilitation, the special needs population, and a full range of fitness training and sports performance.

The foundation of an example exercise structure is a geodesic dome frame structure that is 3-3.5 meters high having an internal diameter of approximately 5-6 meters (or approximately 10' tall with a 12' diameter). These measurements may vary depending on a user's needs and physical capabilities. Numerous retractable and swivelable cable pulley systems (roughly 20-40 units) are positioned inside the dome and are configured provide resistance and exercise assistance. The cable pulleys are attached to the nodes where the dome struts (aluminum or metal) meet and evenly dispersed throughout the dome. Also included are hooks or other attachments to connect other exercise devices, such as bands, ropes, straps, springs, etc. The floor consists of locations where resistance pulley cables emerge and provides a stable foundation when in use. The floor pulley attachments are covered when not utilized. This exercise system solves the limitations of the prior art by allowing simple and quick readjustment of exercises and allows users to be resourceful and creative with unlimited exercise configurations.

The stable structure provided by the geodesic dome allows users to create and develop infinite movements for assistance training for the adaptive community and resistance training for fitness practitioners and athletes. The pulley/cables may be on a swivel thereby making it possible to effectively utilize the space outside the dome. For example, a resistance pulley device may be attached to a hub using a connector that can be moved from an inwardly facing orientation to an outwardly facing orientation so that the user may use the same resistance pulley device both from the outside of the dome and the inside of the dome.

The Matrix Performance System may also be used with digital support systems to measure balance, strength, vitals, dexterity with or without chaos, and other various applications to track progress. Additionally, the Matrix Performance System may incorporate virtual reality (VR) to provide training, feedback, motivation, and entertainment to users.

The cutting edge in human performance focuses on the nervous system and the facia, which corresponds to big circular and figure eight moves in unpredictable situations. While being in the Matrix Performance System and attached to numerous cables at different points on joints, limbs, torso, or head this will be somewhat like being caught in a spider web and having to engage many different muscle systems to move. Another analogous experience is being fully emerged in water sufficient to allow full extension of the user's arms. The user would need a source of oxygen to stay under water for the duration of a workout. The Matrix Performance System is a perfect fit for users who want to get a total system workout in 15-20 minutes.

Typical rehabilitation or fitness equipment is one- or two-dimensional. When changing exercises, the inconvenience of changing equipment and relocating can be time consuming and sometimes annoying. The Matrix Performance System is designed to allow one or several users to immediately move efficiently and effectively from one movement/exercise to another.

Physical therapist, trainers, and coaches have grappled with attaching and adjusting bands, pulleys, and other apparatuses to successfully work with their clients. The Matrix Performance System is designed to allow users to configure exercises in many orientations, which provides therapist, trainers, and coaches with a wide variety of exercises for their clients.

Posture plays a dynamic role in movement and stability of the core. There has been a tendency of inadequate attention to the head position. The head can be just five degrees out of position and have an adverse impact on balance and performance. The Matrix Performance System has attachments for the head for proper head position, thereby enhancing functional movement.

The Matrix Performance System provides exercises to the full spectrum of the various population needs. For example, a leg amputee will have more external or internal rotation in the hip joint while reaching left or right towards a strut on the Matrix Performance System. Users can determine what would be the most effective grip for an individual while doing a back bend. A further example would be having a user hold a lunge position with attachments on both knees thereby creating abduction and adduction chaos, which can be further enhanced by avoiding a swinging medicine ball at the same time.

The Matrix Performance System allows users to coordinate their body while understanding angles, torque, leverage, tension etc. in relation to range of motion alignment and balance.

The Matrix Performance System is for hospitals, rehabilitation centers, fitness clubs, sports performance centers, and high school, college, and professional sports teams. These customers are looking for the latest trend and edge in their field. At this point and time customers are stuck when it comes to multi-plane equipment. Presently, most equipment has barriers that do not allow users to utilize multiple angles simultaneously. For example, some existing equipment has dual cables on extended arms that can be adjusted in various positions and directions. Unfortunately, there are only two cable attachments. The Matrix Performance System allows for multiple cables thereby eliminating the necessity for readjusting extensions. With the Matrix Performance System, the user simply has to reach and grasp one of the numerous pulleys, the resistance level will be the only adjustment. One of the use strategies for fitness clubs and sports teams is to allow numerous people to use the Matrix Performance System at one time. Stations can be set up inside and outside the dome structure, with users rotating among stations in a circuit training manner.

While, the various embodiments of the present invention have been described above, it should be understood that they have been presented by way of example only, and not of limitation. Likewise, the figure may depict an example architectural or other configuration for the invention, which is done to aid in understanding the features and functionality that can be included in the invention. The invention is not restricted to the illustrated example architectures or configurations, but the desired features can be implemented using a variety of alternative architecture and configurations.

Although, the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

The presence of broadening words and phrases such as "one or more," "at least," "but not limited to" or other like phrases in some instances shall not be read to mean that the narrower case is intended or required in instances where such broadening phrases may be absent.

The invention claimed is:

1. An exercise system comprising:

a plurality of struts coupled to each other at multiple hubs to form a dome structure; and a plurality of engaging members, wherein one type of engaging member is attached to a different one of the hubs and is configured to selectively engage with a flywheel-resistance system.

2. The exercise system of claim 1, wherein the flywheel-resistance system is configured to generate a resistance force in proportion to inertia of a flywheel.

3. The exercise system of claim 2, wherein the flywheel-resistance system further comprises a cable coupled to the flywheel, further wherein the cable is configured to rotate the flywheel when a user pulls the cable.

4. The exercise system of claim 1, wherein one type of engaging member is configured to selectively engage with a pulley-based exercising apparatus.

5. The exercise apparatus of claim 4, wherein the pulley-based exercising apparatus comprises:

a rope running over a pulley, wherein the pulley is coupled with the one type of engaging member; and one or more weights mechanically coupled to a first end of the rope, and a handle coupled to a second end of the rope.

6. The exercise system of claim 1, wherein each hub comprises a strut plate with a number of holes configured to be coupled to one or more of the struts.

7. The exercise system of claim 6, wherein one type of engaging member is a component of each strut plate.

8. The exercise system according to claim 6, wherein one type of engaging member is coupled to each strut plate.

9. The exercise system of claim 1, wherein one type of engaging member is configured to selectively engage with a resistance band.

10. The exercise system of claim 1, wherein one type of engaging member is a hook.

11. The exercise system of claim 1, wherein one type of engaging member is a ring.

12. The exercise system of claim 1, wherein material of the plurality of struts is either a wood, plastic, or metal.

13. An exercising apparatus comprising:

a dome shaped member, wherein the dome shaped member includes:

a plurality of struts coupled to each other at multiple hubs;

a plurality of engaging members, wherein each respective engaging member is attached to a different hub; and one or more flywheel-resistance systems configured to securely couple to an engaging member, wherein the one or more flywheel-resistance systems are configured to be moved among engaging members on different hubs.

14. The exercise apparatus of claim 13, wherein the flywheel-resistance system is configured to generate a resistance force in proportion to inertia of a flywheel.

15. The exercise apparatus of claim 14, wherein the flywheel-resistance system further comprises a cable coupled to the flywheel, and wherein the cable is configured to rotate the flywheel when a user pulls the cable.

16. The exercise apparatus of claim 13, wherein the dome shaped member is a geodesic dome.

17. A method, comprising:

providing a dome structure comprising a plurality of struts linked together at a plurality of hubs, wherein two or more of the hubs comprise a coupling member for securely connecting to exercise equipment;

connecting a first rotary inertia resistance system to a first coupling member on the dome structure;

connecting a second rotary inertia resistance system to a second coupling member on the dome structure;

attaching a cable from the first rotary inertia resistance system to a user; and attaching a cable from the second rotary inertia resistance system to the user.

18. The method of claim 17, further comprising:

moving the first rotary inertia resistance system to a third coupling member on the dome structure, wherein moving the first rotary inertia resistance system between the first coupling member and the second coupling member on the dome structure causes a change in a direction of resistance applied to the user.

19. An exercise system comprising:

a plurality of struts coupled to each other at multiple hubs to form a dome structure; and a plurality of engaging members, wherein each engaging member is attached to a separate one of the hubs and is configured to selectively engage with a rotary inertia resistance system.

* * * * *